US006237183B1

(12) United States Patent
Fischer

(10) Patent No.: US 6,237,183 B1
(45) Date of Patent: May 29, 2001

(54) TOOTHBRUSH AND BRUSH HEAD FOR SAID TOOTHBRUSH

(76) Inventor: Franz Fischer, Batzenmoos, CH-6234, Triengen (CH), CH-6234

( * ) Notice: Subject to any disclaimer, the term of this patent is extended or adjusted under 35 U.S.C. 154(b) by 0 days.

(21) Appl. No.: 09/202,179

(22) PCT Filed: May 26, 1997

(86) PCT No.: PCT/CH97/00209

§ 371 Date: Dec. 10, 1998

§ 102(e) Date: Dec. 10, 1998

(87) PCT Pub. No.: WO98/01055

PCT Pub. Date: Jan. 15, 1998

(30) Foreign Application Priority Data

Jul. 8, 1996 (CH) ..... 1705/96

(51) Int. Cl.[7] ..... A46B 9/04
(52) U.S. Cl. ..... 15/167.1; 15/176.1; 15/176.6
(58) Field of Search ..... 15/167.1, 176.1, 15/176.6, 145; 403/20, 321, 322.1, 322.2, 326, 329

(56) References Cited

U.S. PATENT DOCUMENTS

| | | | | |
|---|---|---|---|---|
| 3,181,189 | * | 5/1965 | Leyden | 15/145 |
| 3,369,265 | * | 2/1968 | Halberstadt et al. | 15/145 |
| 4,780,924 | | 11/1988 | Hansen et al. . | |
| 5,224,234 | | 7/1993 | Arsenault et al. . | |
| 5,412,831 | * | 5/1995 | Mongelluzzo | 15/167.1 |
| 5,737,792 | * | 4/1998 | Quigless | 15/145 |
| 5,875,510 | * | 3/1999 | Lamond et al. | 15/167.1 |

FOREIGN PATENT DOCUMENTS

| | | | |
|---|---|---|---|
| 900692 | * | 1/1954 | (DE) . |
| 0199849 | | 11/1986 | (EP) . |
| 2559656 | * | 8/1985 | (FR) . |
| 2044089 | | 3/1979 | (GB) . |
| 2067894 | | 1/1980 | (GB) . |
| DM031636 | | 12/1994 | (WO) . |

* cited by examiner

*Primary Examiner*—Randall E. Chin
(74) *Attorney, Agent, or Firm*—Low and Low

(57) ABSTRACT

A toothbrush and replaceable brush head wherein the brush head is easily and positively inserted and removed by axial motion along the axis of the handle. The handle and head have cooperating tongue and groove configurations providing parallel guides to receive and retain the members in assembled relation by virtue of handle recesses and resilient catches on the brush head, while permitting ready disassembly to remove and replace the brush head. Further, the handle and brush head have cooperating wedge formations to insure positive centering of the brush head along the axis of the handle. The assembly is snug and leaves no room for dirt, thereby enhancing hygiene during repeated use.

10 Claims, 3 Drawing Sheets

TOOTHBRUSH AND BRUSH HEAD FOR SAID TOOTHBRUSH

BACKGROUND OF THE INVENTION

The invention relates to a toothbrush according to those having interchangeable brush heads for ready replacement when the brush head is worn or for insertion of differing brush heads for use by plural users, and to a brush head for the toothbrush.

Toothbrushes and brush heads of this type are known and are available on the market in a variety of designs. Illustrative of prior art constructions are seen in the U.S. patents to Hansen et al U.S. Pat. No. 4,80,924 or Arsenault et al U.S. Pat. No. 5,224,234, for example.

The object of the present invention is to provide a toothbrush and a brush head which, in addition to ensuring that used-up brush heads can be exchanged in a straightforward manner, also ensure that the brush head is fastened securely when the toothbrush is used.

BRIEF SUMMARY OF THE INVENTION

This object is achieved according to the invention by a toothbrush and a brush head having the unique axial insertion and removal of a brush head from the toothbrush handle which insures releasable latching of the head to the handle.

Preferred developments of the toothbrush according to the invention and of the brush head form the structure seen in the drawings and include the flat groove in the handle cooperating with the flat tongue spaced from the base of the brush head, including parallel resilient latches on the brush head detachably interengaging with recesses on the handle adjacent the groove therein.

DESCRIPTION OF THE DRAWINGS

An exemplary embodiment of the toothbrush according to the invention and of the brush head according to the invention is described in more detail hereinbelow and is illustrated in the drawing, in which.

DESCRIPTION OF THE PREFERRED EMBODIMENTS

Figure 2:
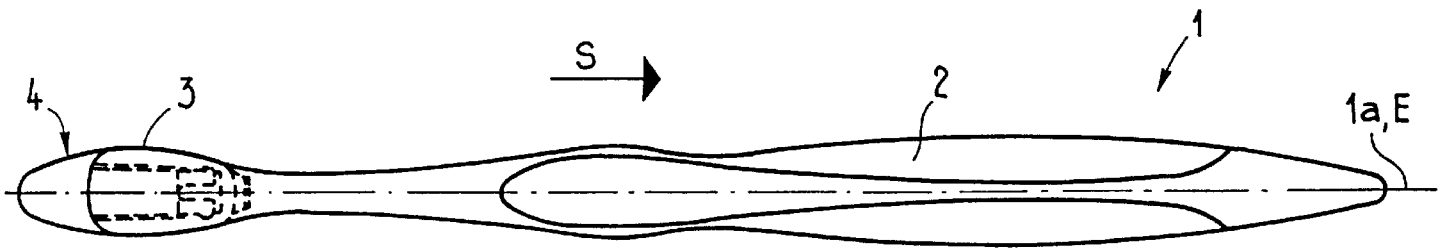
FIG. 2 shows the toothbrush according to FIG. 1 as seen in arrow direction A.
Figure 1:
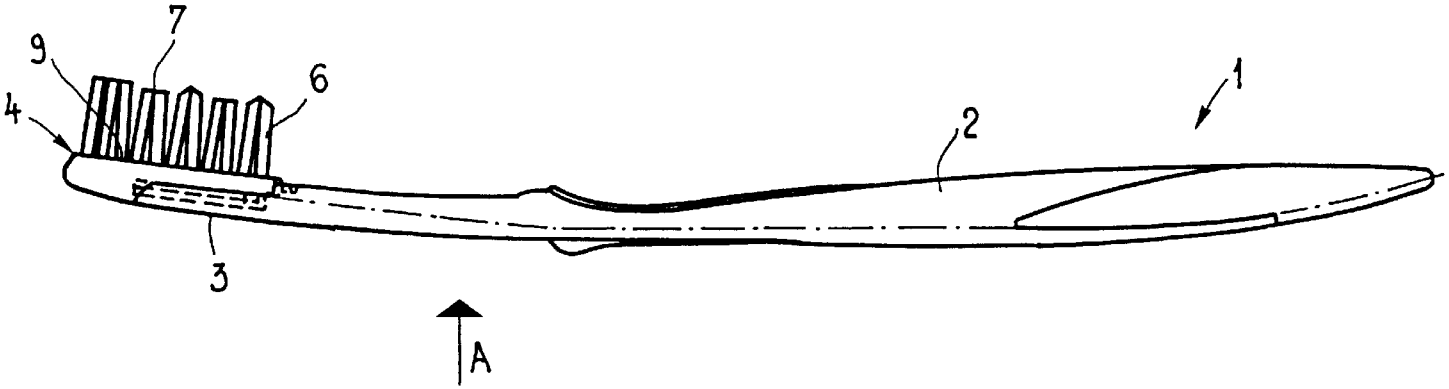
FIG. 1 shows a side view of a toothbrush with a handle and a brush head attached.
Figure 3:
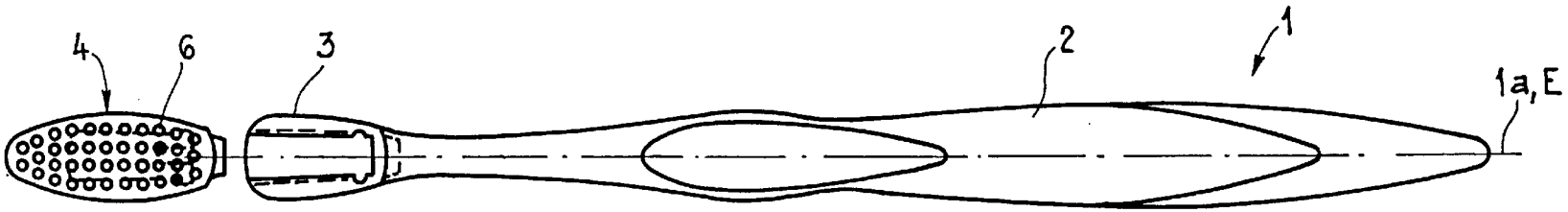
FIG. 3 shows a plan view of the brush head and the handle of the toothbrush according to FIG. 1 in the separated state.

According to FIGS. 1 to 3, a toothbrush 1 has a handle 2 with an exchangeable brush head 4, which can be attached to a front part 3 of the handle 2. The brush head 4 comprises a bristle carrier 5 and bristles 6 which are anchored in the bristle carrier 5 and of which the free ends form a brushing surface 7 (FIG. 1). The bristle carrier 5 is provided with bristles up to its border, as can be seen from FIGS. 3 and 6. The longitudinal axis of the toothbrush is designated by la in FIGS. 2 and 3; it has a plane of symmetry E of the toothbrush 1 running through it.

The bristle carrier 5 and the brushing surface 7 are preferably of oval shape in plan view, as is illustrated in FIGS. 2 and 3; the front part 3 of the handle 2 is also adapted to this shape in plan view. A base surface of the bristle carrier 5, from which the bristles 6 project, is designated by 9 in FIG. 1.

Figure 5:
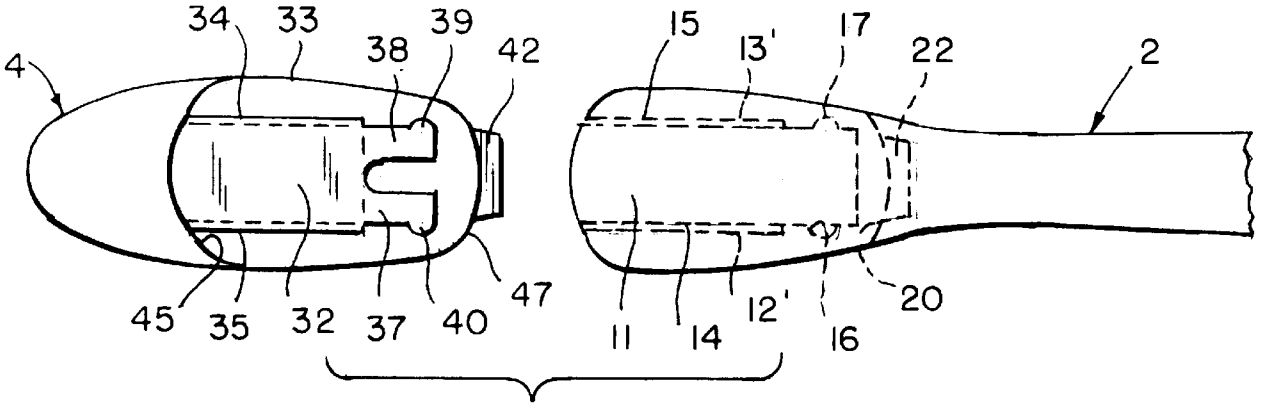
FIG. 5 shows the brush head and the front part of the handle according to FIG. 4 as seen in arrow direction A.
Figure 4:
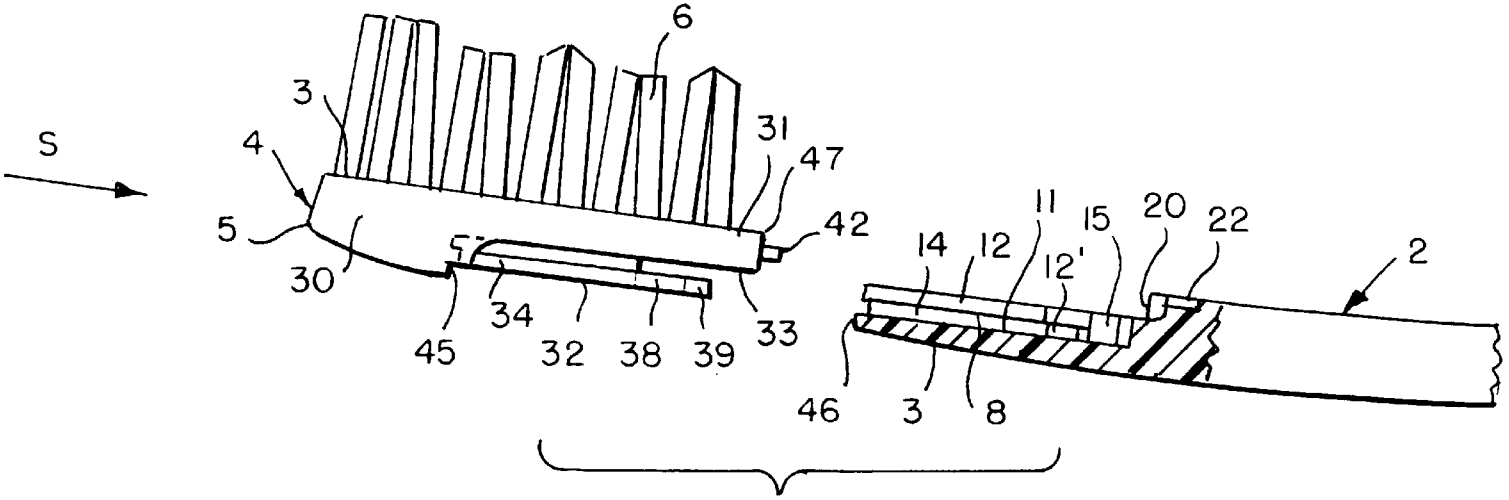
FIG. 4 shows, on a larger scale than in FIG. 1, a side view of the brush head and the front part of the handle in the separated state.
Figure 6:
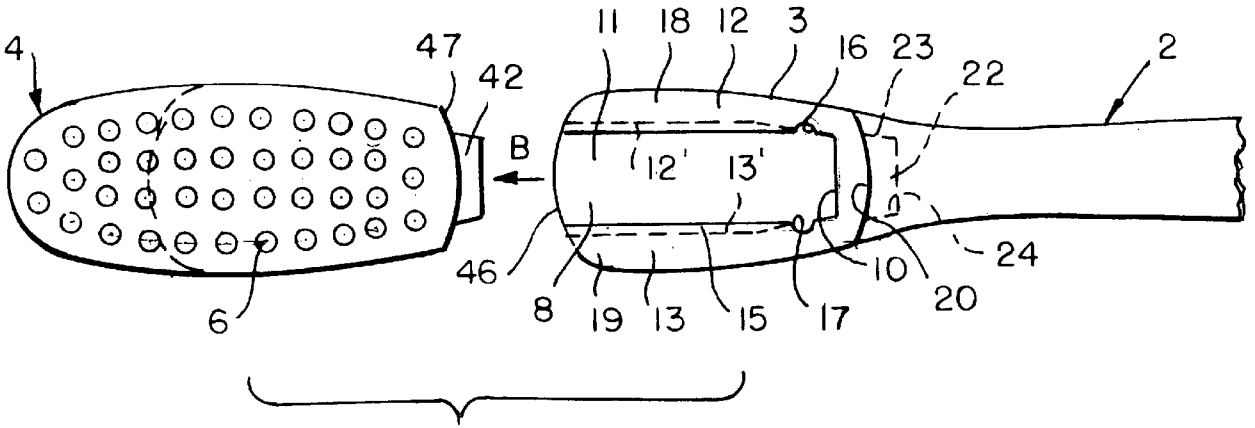
FIG. 6 shows a plan view of the brush head and the front part of the handle according to FIG. 4.

The way in which the brush head 4 is retained in a removable manner in the front part 3 of the handle 2 can easily be seen, in particular, from FIGS. 4 to 6, in which the brush head 4 and the handle 2 are shown in a state in which they have been separated from one another.

Figure 7:
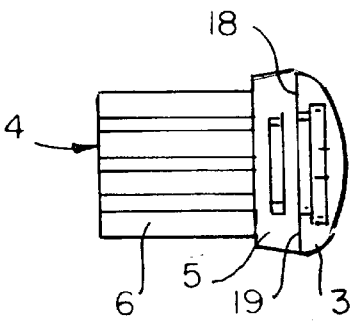
FIG. 7 shows the brush head according to FIG. 6 as seen in arrow direction B.

The front part 3 of the handle 2, said front part being offset by a step from the rest of the handle 2 (cf. FIG. 4), has a recess 8 which is defined by a base 11, a rear wall 10 and two side walls 12, 13. The inner surfaces 12', 13' of the side walls 12, 13 are slightly inclined with respect to the plane of symmetry E and converge rearward toward the wall 10. The inner surfaces 12', 13' of the side walls 12, 13 are each provided with a longitudinal groove 14, 15, which runs in the longitudinal direction of the toothbrush (arrow direction S according to FIGS. 2 and 4), and with a latching groove 16, 17. The latching grooves 16, 17 are located in the rear region, in the vicinity of the rear wall 10. The top surface of the side walls 12, 13 form guide surfaces which are designated by 18, 19 in FIGS. 6 and 7.

A rounded step surface between the front part 3, which is of spoon-like design, and the rest of the handle 2 is designated by 20 in FIGS. 4 to 6. The step surface 20 is provided with a centering recess 22 which is parallel to the base 11 and of which the side surfaces 23, 24 are inclined with respect to the plane of symmetry E such that the centering recess 22 tapers rearward.

The bristle carrier 5 of the brush head 4 has a front part 30, a handle-side, rear part 31 and a retaining part 32, which is provided on the underside of the rear part 31. The retaining part 32 is provided on both sides with a guide strip 34, 35 running in the longitudinal direction S of the toothbrush, the shape and width of the retaining part 32 and of the guide strips 34, 35 corresponding to the longitudinal grooves 14, 15.

On the handle-side, rear, free end, the retaining part 32 is provided with two resiliently elastic latching tongues 37, 38 which can be deformed elastically transversely with respect to the longitudinal direction S, are arranged parallel to the base surface 9, and to a bottom guide surface 33 of the rear part 31, and have in each case one latching protrusion 39, 40 on their outsides. The latching protrusions 39, 40 correspond to the latching grooves 16, 17 in terms of shape and arrangement.

Provided on the rear part 31 of the bristle carrier 5 is a centering protrusion 42 which is designed to mate with the centering recess 22, provided in the handle 2, and has two rearwardly converging side surfaces 43, 44 which are inclined with respect to the plane of symmetry E.

The front part 30 of the bristle carrier 5 has a rounded, bottom step surface 45 at the rear (see FIGS. 4 and 5), and this step surface 45 is configured to mate with a rounded end surface 46 of the front handle part 3. A rear stop surface 47 of the rear bristle-carrier part 31, said stop surface being provided with the abovementioned centering protrusion 42, is likewise rounded such that it corresponds to the step surface 20 of the handle 2.

When a new brush head 4 is attached to the handle 2, the bristle carrier 5 is pushed in the longitudinal direction of the toothbrush (arrow direction S according to FIG. 4), by way of its guide surface 33, onto the top guide surfaces of the front handle part 3, the retaining part 32 being introduced into the recess 8. The guide strips 34, 35 pass into the mating longitudinal grooves 14, 15 and wedge slightly with respect to the same; at the end of this pushing movement, in an end position of the bristle carrier 5, the latching tongues 37, 38 latch into the latching grooves 16, 17 by way of their latching protrusions 39, 40. In this case, the step surface 45 of the bristle carrier 5 comes to rest against the end surface 46 of the handle 2 and the stop surface 47 comes to rest against the step surface 20, it also being the case that the centering protrusion 42 is introduced into the centering recess 22 and wedges with respect to the same. In order to remove a used-up brush head 4, the bristle carrier 5 is manually forced forward in the longitudinal direction of the toothbrush (direction counter to arrow S according to FIG. 4), for example by exerting force on the slightly upwardly projecting stop surface 47. This overcomes the wedging action of the centering elements (centering recess 22, centering protrusion 42) and the latching tongues 37, 38 are forced together elastically transversely with respect to the longitudinal direction S; the latching protrusions 39, 40 are unlatched from the latching grooves 16, 17, and the brush head 4 is pushed out of the recess 8.

This achieves, in a straightforward manner, a fastening for the exchangeable brush head 4 which can easily be released by hand—without using an additional tool—but is nevertheless secure. The additional locking of the two toothbrush parts, said locking being ensured by the centering protrusion 42 and the centering recess 22, improves the hold of the brush head 4 in the handle 2 when one is cleaning one's teeth, i.e. it prevents the brush head 4 from being loose or even from being released from the handle 2 in an undesired manner. This eliminates any risk of injury when the toothbrush is being used. Moreover, in the case of the inventive design of the brush head 4 and of the handle 2, interspaces in which water and extraneous particles could penetrate are advantageously filled well when the two toothbrush parts are joined together; deposits of dirt in the recess 8 are largely prevented, which makes it easier to maintain the toothbrush and is highly advantageous from the point of view of hygiene.

Figure 8:
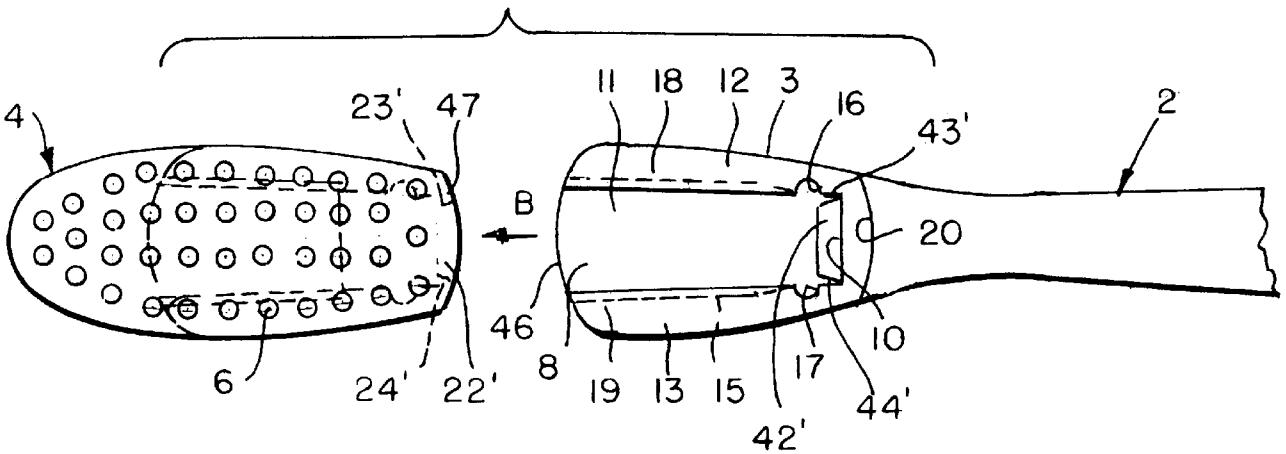
FIG. 8 is similar to FIG. 5 showing a modification wherein the centering protrusion and recess arrangements are in a reversed position from that of FIG. 6.

It would, in fact, be possible for the plug-in connection of the brush head and the handle to be such that the handle is provided with deformable latching tongues with latching protrusions and the bristle carrier is provided with latching recesses. It may, however, be more expedient for parts such as the latching tongues, which are likely to show signs of wear as time progresses, to be assigned to the toothbrush part which can be disposed of once it has been used up. A converse configuration of the additional centering means (centering protrusion on the handle, centering recess in the bristle carrier) is likewise conceivable. Such an arrangement is shown in FIG. 8, wherein the protrusion 42' similar to protrusion 42 in FIG. 6 is on handle 2 extending forwardly from the arcuate surface 20, and the receiving centering recess 22' similar to recess 22 in FIG. 5 is provided on the rear part 31 of bristle carrier 4 and extending thereinto. In like manner, protrusion 42' has converging tapering side surfaces 43' and 44' and which are complementary to like converging tapered side surfaces 23' and 24' of recess 22' to assist centering of the bristle carrier on the handle.

The longitudinal guide for the exchangeable brush head, said longitudinal guide extending in the longitudinal direction S of the toothbrush, could also be formed by guide strips in the handle, in which mating longitudinal grooves in the bristle carrier engage.

The inventive embodiment of the toothbrush and the exchangeable brush head is advantageous not just from an aesthetic point of view but also from an ecological point of view since a comparatively small amount of material is required for the disposable parts.

What is claimed is:

1. A toothbrush with a handle (2) having a detachable brush head (4) thereon, the brush head including a bristle carrier (5) with projecting bristles (6), comprising, a longitudinal guide in a front part (3) of the handle (2), said longitudinal guide extending in the longitudinal direction (S) of the toothbrush, and wherein said brush head can be displaced along said longitudinal guide in order to be detached and exchanged, said brush head being fixed on said handle (2) against displacement in the longitudinal direction (S) by a releasable snap-action connection (16, 17, 37, 38), said snap-action connection being cooperatively associated with said handle front part and said brush head, and, said handle front part and said brush head further having centering elements with complementary wedge configurations including a centering protrusion (42) and a centering recess (22) to securely position and locate the brush head on the handle, and, wherein said longitudinal guide is formed by two laterally spaced longitudinal grooves (14, 15) and said brush head has two guide strips (34, 35) in cooperative engagement therewith.

2. The toothbrush as claimed in claim 1, wherein the centering elements (22, 42) are formed by a centering protrusion (42), which extends in the longitudinal direction (S) of the toothbrush, and by a mating centering recess (22), the side surfaces (23, 24; 43, 44) of which are preferably designed to converge in the pushing-on direction.

3. The toothbrush claimed in claim 2, wherein the centering recess (22) is arranged in the handle (2) and the centering protrusion (42) is arranged on a rear part (31) of the bristle carrier (5).

4. The toothbrush as claimed in claim 2, wherein the centering recess (24') is arranged on a rear part of the bristle carrier (5) and the centering protrusion (42') is arranged in the handle (2).

5. A toothbrush with a handle (2) having a detachable brush head (4) thereon, the brush head including a bristle carrier (5) with projecting bristles (6), comprising, a longitudinal guide in a front part (3) of the handle (2), said longitudinal guide extending in the longitudinal direction (S) of the toothbrush, and wherein said brush head can be displaced along said longitudinal guide in order to be detached and exchanged, said brush head being fixed on said handle (2) against displacement in the longitudinal direction (S) by a releasable snap-action connection (16, 17, 37, 38), said snap-action connection being cooperatively associated with said handle front part and said brush head, and, said handle front part and said brush head further having centering elements with complementary wedge configurations including a centering protrusion (42, 42')

and a centering recess (22, 22') to securely position and locate the brush head on the handle, and, wherein the front part (3) of handle (2) is provided with a recess area (8), and, the bristle carrier (5) is provided with a retaining part (32), the toothbrush further having two mutually opposite longitudinal grooves (14, 15) on said handle adjacent said recess area (8), and, two mutually opposite guide strips (34, 35) on said brush head.

6. The toothbrush as claimed in claim 5, wherein the retaining part (32) is provided with two resiliently elastic latching tongues (37, 38) which are equipped with latching protrusions (39, 40) which can be latched in latching grooves (16, 17), which are provided in the recess (8).

7. The toothbrush as claimed in claim 5, wherein the guide strips (34, 35) and the longitudinal grooves (14, 15) are designed to converge slightly in the pushing-on direction.

8. The toothbrush as claimed in claim 5, wherein the bristle carrier (5) is provided with bristles up to its border.

9. A detachable and replaceable brush head for use with a separate toothbrush handle configured to receive the brush head, comprising:

a bristle carrier (5) having projecting bristles (6), said bristle carrier (5) having a pair of spaced generally longitudinally extending rib-like guide elements (34, 35) thereon, and having a pair of resilient finger-like snap-action latching elements (37, 40) for respective cooperation with a toothbrush handle when associated therewith, said bristle carrier further having a tapered centering element (42, 22') thereon disposed longitudinally adjacent one end of the brush head for respective cooperation with a toothbrush handle when associated therewith to center the brush head on a handle, and, wherein said centering element on said brush head is a rearwardly-facing recess (22') in the rear portion of the brush head, said recess having complementary tapering walls (23', 24') on either side thereof converging in a direction toward the front of the brush head.

10. The brush head as claimed claim 9, wherein the bristle carrier (5) is provided with bristles up to its border.

* * * * *